US009360161B2

(12) United States Patent
Barker

(10) Patent No.: US 9,360,161 B2
(45) Date of Patent: Jun. 7, 2016

(54) COMPRESSED NATURAL GAS STORAGE AND DISPENSING SYSTEM

(71) Applicant: R. Keith Barker, Walhalla, SC (US)

(72) Inventor: R. Keith Barker, Walhalla, SC (US)

( * ) Notice: Subject to any disclaimer, the term of this patent is extended or adjusted under 35 U.S.C. 154(b) by 388 days.

(21) Appl. No.: 14/161,245

(22) Filed: Jan. 22, 2014

(65) Prior Publication Data

US 2014/0202585 A1 Jul. 24, 2014

Related U.S. Application Data

(60) Provisional application No. 61/849,207, filed on Jan. 22, 2013.

(51) Int. Cl.

| | |
|---|---|
| ***F17C 5/06*** | (2006.01) |
| ***F17C 5/00*** | (2006.01) |
| ***F17C 7/00*** | (2006.01) |
| ***F17C 9/00*** | (2006.01) |
| ***F17C 9/02*** | (2006.01) |

(52) U.S. Cl.

CPC . *F17C 5/06* (2013.01); *F17C 5/007* (2013.01); *F17C 7/00* (2013.01); *F17C 9/00* (2013.01); *F17C 9/02* (2013.01); *F17C 2203/0663* (2013.01); *F17C 2205/0138* (2013.01); *F17C 2205/0142* (2013.01); *F17C 2205/0326* (2013.01); *F17C 2221/033* (2013.01); *F17C 2223/0123* (2013.01); *F17C 2223/0161* (2013.01); *F17C 2223/033* (2013.01); *F17C 2223/036* (2013.01); *F17C 2225/0123* (2013.01); *F17C 2225/036* (2013.01); *F17C 2227/0157* (2013.01); *F17C 2227/0185* (2013.01); *F17C 2227/0393* (2013.01); *F17C 2250/043* (2013.01); *F17C 2250/0439* (2013.01); *F17C 2250/0452* (2013.01); *F17C 2260/025* (2013.01); *F17C 2260/056* (2013.01); *F17C 2265/015* (2013.01); *F17C 2265/065* (2013.01); *F17C 2270/0139* (2013.01); *F17C 2270/07* (2013.01)

(58) Field of Classification Search

CPC ..... F17C 2225/0123; F17C 2265/065; F17C 2223/0123; F17C 2227/043; F17C 5/06

USPC ..... 141/1, 2, 11, 18, 197

See application file for complete search history.

(56) References Cited

U.S. PATENT DOCUMENTS

| | | | | | |
|---|---|---|---|---|---|
| 5,351,726 | A * | 10/1994 | Diggins | F17C 5/06 | 123/525 |
| 5,409,046 | A * | 4/1995 | Swenson | F17C 9/02 | 141/11 |
| 5,499,739 | A * | 3/1996 | Greist, III | B29C 53/602 | 138/30 |
| 7,624,770 | B2 * | 12/2009 | Boyd | F17C 5/007 | 141/11 |

(Continued)

*Primary Examiner* — Mark A Laurenzi
*Assistant Examiner* — Timothy P Kelly
(74) *Attorney, Agent, or Firm* — Thomas C. Saitta

(57) ABSTRACT

A compressed natural gas storage and dispensing system having bulk storage tanks in fluid communication with a natural gas supply source; a primary compressor delivering the natural gas to the bulk storage tanks; dispensing storage tanks in fluid communication with the bulk storage tanks and in fluid communication with fuel dispensers; a secondary compressor delivering the natural gas to the dispensing storage tanks from the bulk storage tanks; wherein when the pressure within the dispensing storage tanks falls below a predetermined minimum pressure, natural gas is delivered from the bulk storage tanks to the dispensing storage tanks, and wherein when the pressure in the bulk storage tanks falls below a predetermined minimum pressure, natural gas is delivered from the supply source to the bulk storage tanks.

12 Claims, 1 Drawing Sheet

(56) References Cited

U.S. PATENT DOCUMENTS

2011/0240139 A1* 10/2011 Ding ..... F17C 5/007 137/171
2014/0261863 A1* 9/2014 Cohen ..... F17C 5/06 141/4
2015/0090364 A1* 4/2015 Elgowainy ..... F17C 5/06 141/4

* cited by examiner

COMPRESSED NATURAL GAS STORAGE AND DISPENSING SYSTEM

This application claims the benefit of U.S. Provisional Patent Application Ser. No. 61/849,207, the disclosure of which is incorporated herein by reference.

BACKGROUND OF THE INVENTION

This invention relates generally to the field of receiving, storing and dispensing compressed natural gas, and more particularly relates to systems and methods for receiving natural gas from pipelines or delivery vehicles, compressing and storing the natural gas, and dispensing the natural gas into vehicles from fuel islands.

Using compressed natural gas ("CNG") for motor vehicle fuel is relatively new in the U.S. It is anticipated that most CNG fuel islands, designed and structured to dispense CNG to individual vehicles in the manner of standard gas stations, will obtain natural gas by direct connection to utility pipelines, as provided by municipal infrastructure. However, the gas pressure and volume from these pipelines is insufficient to support fast-fill, i.e., CNG-on-demand, islands. Inconsistent demands for natural gas throughout the day by neighboring customers sharing the pipeline create widely disparate volume and pressures that are detrimental for optimum operation of open-traffic fast-fill CNG fuel islands directed at refueling motor vehicles. Decreased pipeline pressure increases the time required to fuel vehicles, and as more vehicles convert to CNG, the fuel demand may exceed the supply available to any given fuel island because the island is dependent on the supply offered by the neighborhood pipeline at any given time.

It is an object of this invention to address and solve the above problems by providing a system of CNG storage tanks and gas compressors which are designed to collect, store and compress natural gas on site in a manner that accounts for fluctuations in gas supply from pipelines or other sources and accounts for fluctuations in vehicle refueling demands.

SUMMARY OF THE INVENTION

In various embodiments, a CNG fast-fill receiving, storing and dispensing fuel island is provided comprising preferably at least two banks or sets of tanks—a bank of "bulk storage tanks" and a bank of "dispensing storage tanks". The bulk storage tanks are connected to the natural gas utility pipeline and are refilled to capacity throughout the course of the day via open and continuous access to the pipeline, the bulk storage tanks being refilled at the relatively low flow rate produced by pipeline pressure via compressors that raise the pressure to 5000 psi for example. The dispensing storage tanks receive the gas from the bulk storage tanks as needed as a result of the fuel being dispensed from the dispensing tanks to the CNG dispensers and into the motor vehicles. The depletion is measured in pressure, such that when the dispensing storage tanks go below a designated minimum pressure, typically 3600 psi, valves that connect the two banks of tanks through a manifold system of pipes automatically transfer the gas stored in the bulk storage tanks into the dispensing storage tanks. To insure constant high pressure within the dispensing tanks, the gas from the bulk storage tanks is recompressed up to 5000 psi for example prior to delivery to the dispensing storage tanks. Because a relatively low flow rate for filling the bulk storage tanks is acceptable, relatively low horse power compressors may be utilized. Likewise, relatively low horsepower compressors may be utilized to recompress the gas delivered from the bulk storage tanks, since the gas will be at a pressure of greater than 3600 psi. This same design can also be employed to accommodate other CNG sources, such a tube trailer, or liquid natural gas (LNG), where the source of the natural gas is an LNG tanker instead of the municipal utility gas pipeline.

In an alternative description, the invention is a compressed natural gas storage and dispensing system adapted to deliver natural gas to motor vehicles, the system comprising: a plurality of bulk storage tanks in fluid communication with a natural gas supply source, said bulk storage tanks being type 4, 4/5 or 5 tanks composed of a resin composite material; at least one primary compressor drawing natural gas from said supply source, compressing the natural gas to a desired pressure, and delivering the natural gas to said bulk storage tanks, said at least one primary compressor being from 50-150 horsepower; a plurality of dispensing storage tanks in fluid communication with said bulk storage tanks and in fluid communication with fuel dispensers, said dispensing storage tanks being type 4, 4/5 or 5 tanks composed of a resin composite material, the number of said dispensing storage tanks being less than the number of said bulk storage tanks; at least one secondary compressor receiving said natural gas from said bulk storage tanks, compressing the natural gas to a desired pressure, and delivering said natural gas to said dispensing storage tanks, said at least one secondary compressor being from 50-150 horsepower; wherein when the pressure within said dispensing storage tanks falls below a predetermined minimum pressure, natural gas is delivered from said bulk storage tanks to said dispensing storage tanks, and wherein when the pressure in said bulk storage tanks falls below a predetermined minimum pressure, natural gas is delivered from said supply source to said bulk storage tanks; and further wherein said predetermined minimum pressure in said bulk storage tanks and said predetermined minimum pressure in said dispensing storage tanks is approximately 3600 psi, and wherein said at least one primary condenser and said at least one secondary condenser are adapted to compress the natural gas to a minimum of approximately 5000 psi.

The invention is also a method of refilling motor vehicles comprising the steps of: providing a compressed natural gas storage and dispensing system adapted to deliver natural gas to motor vehicles, the system comprising a plurality of bulk storage tanks in fluid communication with a natural gas supply source, said bulk storage tanks being type 4, 4/5 or 5 tanks composed of a resin composite material; at least one primary compressor drawing natural gas from said supply source, compressing the natural gas to a desired pressure, and delivering the natural gas to said bulk storage tanks, said at least one primary compressor being from 50-150 horsepower; a plurality of dispensing storage tanks in fluid communication with said bulk storage tanks and in fluid communication with fuel dispensers, said dispensing storage tanks being type 4, 4/5 or 5 tanks composed of a resin composite material, the number of said dispensing storage tanks being less than the number of said bulk storage tanks; at least one secondary compressor receiving said natural gas from said bulk storage tanks, compressing the natural gas to a desired pressure, and delivering said natural gas to said dispensing storage tanks, said at least one secondary compressor being from 50-150 horsepower; wherein when the pressure within said dispensing storage tanks falls below a predetermined minimum pressure, natural gas is delivered from said bulk storage tanks to said dispensing storage tanks, and wherein when the pressure in said bulk storage tanks falls below a predetermined minimum pressure, natural gas is delivered from said supply source to said bulk storage tanks; receiving the natural gas from said supply source at less than 3600 psi into said at least one primary compressor; compressing the natural gas in said at least one primary compressor to at least 5000 psi; delivering said natural gas from said at least one primary compressor to said bulk storage tanks when said pressure within any of said bulk storage tanks is less than 5000 psi; delivering the natural gas from said bulk storage tanks to said dispensing storage tanks when said pressure within said dispensing storage tanks is less than 3600 psi through said at least one secondary compressor, said secondary compressor compressing the natural gas to at least 5000 psi; and delivering the natural gas from said dispensing tanks to said fuel dispensers and refilling the motor vehicles; and further wherein said step of delivering the natural gas from said bulk storage tanks to said dispensing storage tanks when said pressure within said dispensing storage tanks is less than 3600 psi through said at least one secondary compressor is performed by drawing the natural gas from one of said bulk storage tanks at a time.

DETAILED DESCRIPTION

Figure 1:
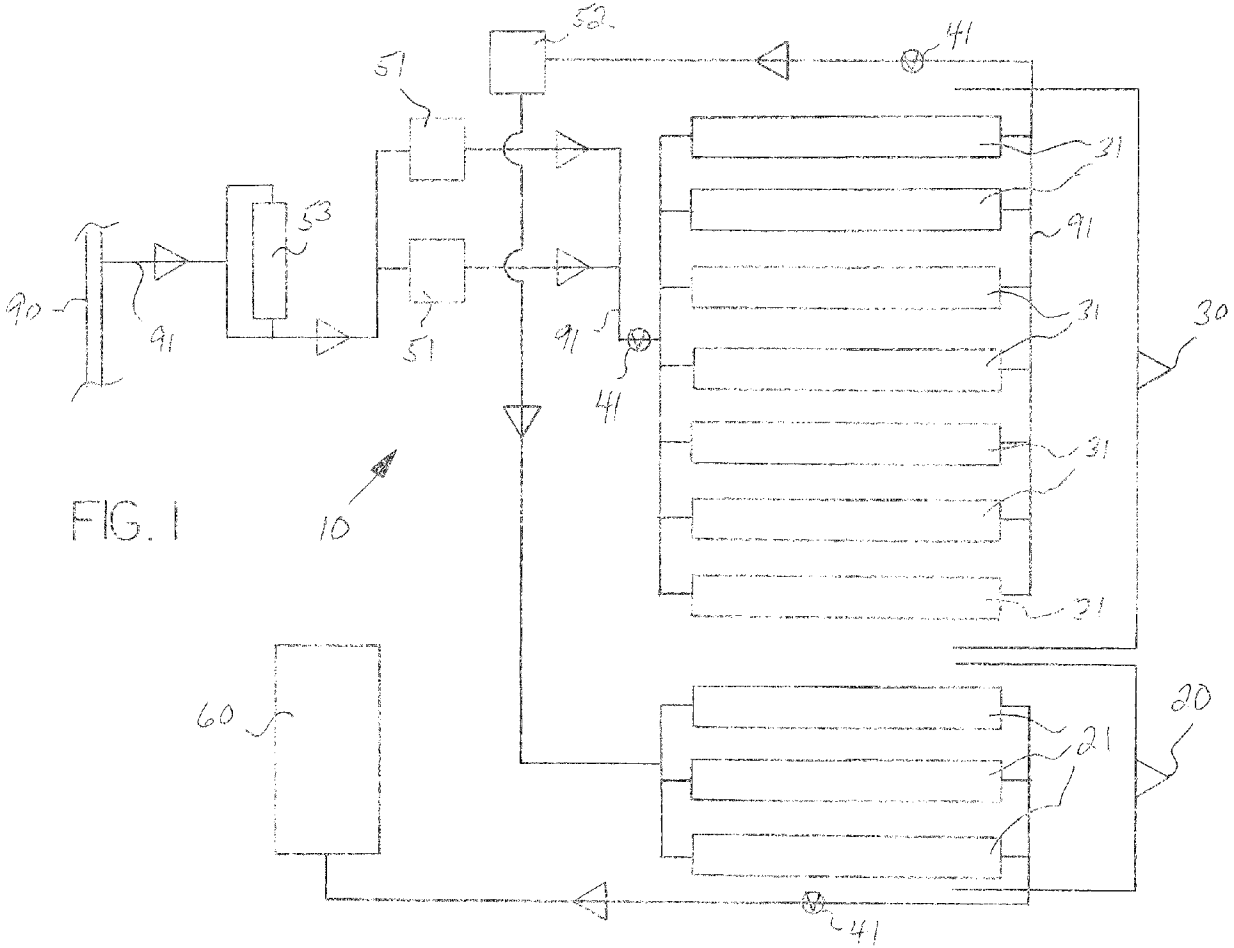
FIG. 1 is a schematic illustration of an embodiment of the CNG fast-fill receiving, storing and dispensing fuel island system.

With reference to any drawings and charts, embodiments of the invention will now be described in enabling detail. In general, an exemplary embodiment of the method and system is a CNG receiving, storing and dispensing fast-fill fuel island system 10 adapted to receive vehicular traffic acquiring CNG on demand, the system 10 comprising preferably at least two banks or sets of CNG storage tanks—a bank 20 of dispensing storage tanks 21 and a bank 30 of bulk storage tanks 31. The bulk storage tanks 31 are connected to the natural gas utility pipeline 90 and are continuously being filled to capacity throughout the course of the day as needed via open and continuous conduits 91 communicating with the pipeline 90, with the gas being suctioned from the pipeline 90 and compressed by primary compressors 51 to the desired pressure (5000 psi for example). The dispensing storage tanks 21 receive the gas from the bulk storage tanks 31 as needed as a result of the fuel being dispensed through the CNG fuel dispensers 60. A dryer system 53 may be provided between the pipeline 90 and the primary compressors 51. The depletion of the dispensing storage tanks 21 is measured in pressure, such that when any of the dispensing storage tanks 21 go below a designated minimum pressure (3600 psi for example), typically chosen to be the minimum pressure required for delivery of the CNG into the motor vehicles in a reasonably short time period, valves 41 that connect the two banks 20/30 of tanks 21/31 through a manifold system of pipes 40 automatically transfer the gas stored in the bulk storage tanks 31 into the dispensing storage tanks 21. To insure constant high pressure within the dispensing storage tanks 21, the gas from the bulk storage tanks 31 is recompressed prior to delivery to the dispensing storage tanks 21 by secondary compressors 52.

The source of the natural gas can be either a municipal utility gas pipeline 90, a mobile CNG tube trailer (not shown), or from a large volume mobile tanker storing LNG (not shown). In the event of LNG, the liquid must first be converted into a gaseous state. Once in the gaseous state, the process is the same as described in general above. The gas is drawn into the system through suction caused by one or more primary compressors 51.

The storage tank banks 20 and 30 are connected together with manifold pipelines 40 and appropriate valves 41. Preferably the tanks 21/31 are resin composite tanks of the type known in the industry as type 4, 4/5 or 5, as tanks of this composition are capable of holding more gas at high pressure and at lower cost of manufacture than conventional metal tanks. The number of tanks 21/31 is dependent on how much fuel will need to be stored and how much fuel should be available for dispensing at a particular site dependent on demand. A sufficient number of dispensing storage tanks 21 should be provided to meet the projected peak fueling requirements of the fuel island system 10, to be measured in standard cubic feet per minute (scfm). The number of bulk storage tanks 31 is determined as a result of the expected demand on the dispensing storage tanks 21, but there will be a significantly greater number of bulk storage tanks 31 than dispensing storage tanks 21. The bulk storage tanks 31 are filled in sequence through the action of primary compressors 51 that compress the natural gas delivered at low pressure from the pipeline 90 or other source up to a desired high pressure (5000 psi for example), and are filled whenever the pressure within a bulk storage tank 31 falls below a predetermined pressure, regardless of whether or not fuel is being dispensed through a dispensing storage tank 21. Because of the large number of bulk storage tanks 31, the refilling process can be at a relatively low flow rate, since the supply of natural gas is continuous and draw down on the bulk storage tanks 31 occurs only during refilling of the dispensing storage tanks 21 whenever pressures in the dispensing storage tanks 21 are reduced to predetermined minimum levels (3600 psi for example).

Compressors 51/52 draw the gas through the system 10 via suction, the compressors 51/52 being activated by sensors when pressure in either the bulk storage tanks 31 or the dispensing storage tanks 21 is reduced to a predetermined level. The valves 41 that transfer the gas to and from tanks 21/31 and compressors 51/52 operate automatically based on pressures, timers and temperatures, with the valves 41 being monitored by a sequencing panel. The sequencing panel will also have the ability to allow manual override of the valves 41. The goal of the storage system 10 is to insure the dispensing storage tanks 21 are filled to maximum fuel capacity at all times. The storage system 10 will also have safety monitoring for fire, smoke, heat, and UV hydrocarbon detection with overhead fire protection deployment such as sprinkler systems loaded with fire suppressants.

A major advantage of the system as described is its ability to provide to the CNG dispensers 60 a sufficient quantity of CNG at the desired minimum pressure for efficient delivery to the motor vehicles, wherein the source of the natural gas is a low pressure, low flow rate and fluctuating volume source, by utilizing relatively low horsepower compressors 51/52. For example, 50-150 horsepower compressors 51/52 may be utilized. Conventionally such low horsepower compressors would not be able to provide CNG above a minimum desired psi at a flow rate suitable for refilling vehicles in a timely manner, and therefore known systems utilize compressors of much greater horsepower, which are incrementally more expensive. Because the filling of the bulk storage tanks 31 does not need to be rapid and instead may be accomplished over long time periods, and because the CNG delivered from the bulk storage tanks 31 is passed through secondary compressors to recompress the CNG prior to delivery to the dispensing storage tanks 21, these 50-150 horsepower compressors are sufficient.

Prophetic Example

As shown in FIG. 1, natural gas comes in off natural gas pipeline 90 from existing municipal gas utility infrastructure onto the property through conduit 91. The gas is sucked through the conduit 91 by suction created by a pair of primary compressors 51. The conduit 91 carries the gas through a dryer system 53 into the primary compressors 51 where it is compressed to 5,000 psi or higher and sequenced throughout the manifold pipes 40 and into the bulk storage tanks 31. In the prophetic example, there are 10 total cylindrical storage tanks 21 and 31. These 10 tanks are partitioned into two sets or banks, shown as bank 20 of the dispensing storage tanks 21 and bank 30 of the bulk storage tanks 31.

Bank 20 provides fuel to the fuel dispensers 60 on an on-demand basis. When the pressure within the dispensing storage tanks 21 falls below 3600 psi, valves 41 open to draw gas from bank 30 into bank 20, the gas drawn from tanks 31 being recompressed to at least 5,000 psi prior to delivery to bank 20. Preferably, gas will be drawn from tanks 31 sequentially, such that when pressure in a first bulk storage tank 31 falls below the predetermined minimum pressure, output from the first tank 31 is stopped and gas is taken from a second tank 31, etc., until all dispensing tanks 21 are refilled. When output from the first tank 31 is stopped, or even possibly during the delivery of gas from the first tank 31, primary compressors 51 start refilling of this first bulk storage tank 31 from the natural gas source pipeline 90. This system insures that there will always be a sufficient supply of natural gas at the required pressure (5000 psi) to be used as needed by fuel island demand.

Preferably, the tanks 21/31 in the example are designed to handle at least 5,000 psi, and preferably higher, and should be cylindrical and double stacked; a suitable size being 21 inches in diameter and 84 inches long, so they can fit below grade into the fuel island culvert design of patent application Ser. No. 13/506,898. As previously discussed, type 4, 4/5 or 5 tanks composed of a resin or hybrid are preferred. The same system can be employed above ground, independent of the fuel island culvert design. The higher the psi, the more gas can be stored in the tanks 21/31. Whenever psi falls to 3,600 or below, the tanks 21/31 will automatically refill from their respective source via the compressor units 51/52.

The system 10 as described comprises features advantageous, novel and non-obvious over the known prior art systems. The system allows for reduced time to fill-up using CNG, similar to conventional fueling with gasoline or diesel; greater access to CNG fueling for non-fleet vehicles, as most CNG stations are restricted to fleets due to the time it takes to fill a vehicle and the limited supply of CNG available for compression; which results in most fleet CNG stations scheduling fill-ups by appointment only; uninterrupted, continuous and systematic supply of CNG fuel to dispenser(s); CNG stations will be more attractive to investors and more accepting by the public because CNG will be dispensed faster and efficiently without the fear of spending too much time at a dispenser and without fear of not having enough fuel to fill up at a convenient time and will have lower installation and operational costs.

It is contemplated and understood that equivalents and substitutions for certain elements described above may be obvious to those of ordinary skill in the art, and therefore the true scope and definition of the invention is to be as set forth in the following claims.

I claim:

1. A compressed natural gas storage and dispensing system comprising:

a plurality of bulk storage tanks in fluid communication with a natural gas supply source; a primary compressor drawing natural gas from said supply source, compressing the natural gas to a desired pressure, and delivering the natural gas to said bulk storage tanks;

a plurality of dispensing storage tanks in fluid communication with said bulk storage tanks and in fluid communication with fuel dispensers;

a secondary compressor receiving said natural gas from said bulk storage tanks, compressing the natural gas to a desired pressure, and delivering said natural gas to said dispensing storage tanks;

wherein when the pressure within said dispensing storage tanks falls below a predetermined minimum pressure, natural gas is delivered from said bulk storage tanks to said dispensing storage tanks, wherein when the pressure in said bulk storage tanks falls below a predetermined minimum pressure, natural gas is delivered from said supply source to said bulk storage tanks, wherein said predetermined minimum pressure in said bulk storage tanks and said predetermined minimum pressure in said dispensing storage tanks is approximately 3600 psi, and wherein said primary compressor and said secondary compressor are adapted to compress the natural gas to a minimum of approximately 5000 psi.

2. The system of claim 1, comprising a plurality of primary compressors and a plurality of secondary compressors.

3. The system of claim 1, wherein the number of bulk storage tanks is greater than the number of dispensing storage tanks.

4. The system of claim 1, wherein said fuel dispensers are adapted to deliver natural gas to motor vehicles.

5. The system of claim 1, wherein said primary and secondary compressors are from 50-150 horsepower compressors.

6. The system of claim 1, wherein said bulk storage tanks and said dispensing storage tanks are type 4, 4/5 or 5 tanks composed of a resin composite material.

7. The system of claim 1, wherein said primary compressor, said secondary compressor, said bulk storage tanks and said dispensing storage tanks are disposed below ground and wherein said fuel dispensers are disposed above ground.

8. The system of claim 1, wherein said secondary compressor receives natural gas from only one of said bulk storage tanks when delivering natural gas to said dispensing storage tanks.

9. The system of claim 8, wherein said secondary compressor receives natural gas from another of said bulk storage tanks when the pressure within said one of said bulk storage tanks falls below said bulk storage tank predetermined minimum pressure.

10. A compressed natural gas storage and dispensing system adapted to deliver natural gas to motor vehicles, the system comprising:

a plurality of bulk storage tanks in fluid communication with a natural gas supply source, said bulk storage tanks being type 4, 4/5 or 5 tanks composed of a resin composite material;

at least one primary compressor drawing natural gas from said supply source, compressing the natural gas to a desired pressure, and delivering the natural gas to said bulk storage tanks, said at least one primary compressor being from 50-150 horsepower;

a plurality of dispensing storage tanks in fluid communication with said bulk storage tanks and in fluid communication with fuel dispensers, said dispensing storage tanks being type 4, 4/5 or 5 tanks composed of a resin composite material, the number of said dispensing storage tanks being less than the number of said bulk storage tanks;

at least one secondary compressor receiving said natural gas from said bulk storage tanks, compressing the natural gas to a desired pressure, and delivering said natural gas to said dispensing storage tanks, said at least one secondary compressor being from 50-150 horsepower;

wherein when the pressure within said dispensing storage tanks falls below a predetermined minimum pressure, natural gas is delivered from said bulk storage tanks to said dispensing storage tanks, wherein when the pressure in said bulk storage tanks falls below a predetermined minimum pressure, natural gas is delivered from said supply source to said bulk storage tanks, wherein said predetermined minimum pressure in said bulk storage tanks and said predetermined minimum pressure in said dispensing storage tanks is approximately 3600 psi, and wherein said at least one primary compressor and said at least one secondary compressor are adapted to compress the natural gas to a minimum of approximately 5000 psi.

11. A method of refilling motor vehicles comprising the steps of:

providing a compressed natural gas storage and dispensing system adapted to deliver natural gas to motor vehicles, the system comprising a plurality of bulk storage tanks in fluid communication with a natural gas supply source, said bulk storage tanks being type 4, 4/5 or 5 tanks composed of a resin composite material; at least one primary compressor drawing natural gas from said supply source, compressing the natural gas to a desired pressure, and delivering the natural gas to said bulk storage tanks, said at least one primary compressor being from 50-150 horsepower; a plurality of dispensing storage tanks in fluid communication with said bulk storage tanks and in fluid communication with fuel dispensers, said dispensing storage tanks being type 4, 4/5 or 5 tanks composed of a resin composite material, the number of said dispensing storage tanks being less than the number of said bulk storage tanks; at least one secondary compressor receiving said natural gas from said bulk storage tanks, compressing the natural gas to a desired pressure, and delivering said natural gas to said dispensing storage tanks, said at least one secondary compressor being from 50-150 horsepower;

receiving the natural gas from said supply source at less than 3600 psi into said at least one primary compressor; compressing the natural gas in said at least one primary compressor to at least 5000 psi; delivering said natural gas from said at least one primary compressor to said bulk storage tanks when the pressure within any of said bulk storage tanks is less than 5000 psi;

delivering the natural gas from said bulk storage tanks to said dispensing storage tanks when the pressure within said dispensing storage tanks is less than 3600 psi through said at least one secondary compressor, said secondary compressor compressing the natural gas to at least 5000 psi; and delivering the natural gas from said dispensing tanks to said fuel dispensers and refilling the motor vehicles.

12. The method of claim 11, wherein said step of delivering the natural gas from said bulk storage tanks to said dispensing storage tanks when said pressure within said dispensing storage tanks is less than 3600 psi through said at least one secondary compressor is performed by drawing the natural gas from one of said bulk storage tanks at a time.

* * * * *